United States Patent [19]

Kaes

[11] Patent Number: 5,076,855

[45] Date of Patent: Dec. 31, 1991

[54] METHOD OF AND CLEANING AGENT FOR THE CLEANING OF COMPRESSORS ESPECIALLY GAS TURBINES

[75] Inventor: Gertrude Kaes, Vienna, Austria

[73] Assignee: Lang & Co. Chemisch-Technische Produkte Kommanditgesellschaft, Mauerbach/Wien, Austria

[21] Appl. No.: 604,775

[22] Filed: Oct. 26, 1990

[30] Foreign Application Priority Data

Oct. 30, 1989 [AT] Austria ..... 2495/89

[51] Int. Cl.[5] ..... B08B 3/08; C23G 1/00; C11D 1/62

[52] U.S. Cl. ..... 134/2; 134/3; 134/19; 134/20; 134/26; 134/28; 134/29; 134/32; 134/40; 252/542; 252/544; 252/547; 252/DIG. 1; 252/DIG. 2

[58] Field of Search ..... 134/2, 3, 19, 20, 26, 134/28, 29, 22.19, 23, 33, 40, 42; 252/174.24, 542, 544, 547, 548, DIG. 1, DIG. 2

[56] References Cited

U.S. PATENT DOCUMENTS 4,808,235 2/1989 Woodson et al. ..... 134/33
5,002,078 3/1991 Kaes ..... 134/2

*Primary Examiner*—Theodore Morris
*Assistant Examiner*—Saeed Chaudhry
*Attorney, Agent, or Firm*—Herbert Dubno

[57] ABSTRACT

Compressors of gas turbines are cleaned with a solution consisting of heteropolar-compound, wash active agents consisting of:

at least one substance selected from the group which consists of polymers and copolymers of organic unsaturated acids with a molecular weight of at least 500 capable of forming the heteropolar compounds with an alkaline cationic, wash active agents; and at least one substance selected from the group which consists of nonionic wash active agents, in a compressor-cleaning effective concentration, the solutions in use having a metal ion content of less than 25 ppm and a pH value at said concentration between 6 and 8.

9 Claims, No Drawings

METHOD OF AND CLEANING AGENT FOR THE CLEANING OF COMPRESSORS ESPECIALLY GAS TURBINES

CROSS REFERENCE TO RELATED APPLICATION

This application is related to copending application Ser. No. 07/564,173 filed 7, Aug. 1990 (U.S. Pat. No. 5,002,078).

1. Field of the Invention

The present invention relates to a cleaning agent for compressors, especially those of gas turbines and to a method of cleaning them.

2. Background of the Invention

Gas turbines are finding increasing numbers of applications and uses in modern technology and are expected in the next decades to become the most economical and flexible method of energy production from carbon and hydrogen containing fuels.

Gas turbines have been found to be particularly advantageous in the developing energy system referred to as cogeneration and which involves the joint generation of electric current and steam, where such gas turbines have significant advantages.

Gas turbines for use in energy generating applications and in many other cases may consist of a compressor and a turbine which have a common shaft or are so interconnected that the apparatus can operate in accordance with the Joule cycle, i.e. at constant pressure. Air is compressed in the compressor and is fed to a combustion chamber in which the temperature of the gases is increased while the pressure remains constant. The hot gases then drive the turbine.

It is known that the compressors of such gas turbines become soiled and coated with deposits which reduce the operating efficiency. Accordingly, such compressors must be cleaned continuously or repeatedly whether during a standstill of the gas turbine or, more advantageously, during its operation, i.e. by a so-called "on-line" cleaning system. This latter type of cleaning has developed from the traditional scrubbing of such turbines while they are out of operation, at reduced rotational speeds (unfired). The advantage of the on-line cleaning is that the compressor efficiency can be maintained or improved without the need to bring the apparatus to standstill and without cooling down of the apparatus. Since downtime can be avoided, the overall output of the apparatus can be improved.

Basically such on-line cleaning should be carried out periodically or at otherwise determined time intervals. A complete replacement of the conventional off-line scrubbing or conventional dry cleaning of the turbine during an interruption in operation is not required by the invention. However, the on-line cleaning allows fewer off-line cleaning cycles to be used and hence fewer interruptions in the operation of the apparatus in which also dry cleaning agents, such as ground nut shells, hard rice, synthetic resin particles or the like are employed and may, because of their abrasive characteristics, give rise to abrasion of the compressor blades and their coatings.

Up to now, on-line scrubbing mainly uses demineralized water, for example condensate water, having a total content of solids to a maximum of 5 ppm and containing the metals (Na+K+Pb+V) to a maximum of 0.5 ppm.

With respect to the on-line cleaning it is to be noted that the deposits which may arise on the compressor blades can accumulate in the hot regions in the turbine and can there have detrimental effects. It is necessary, as a consequence, depending upon the fields of application, operating conditions and the like to carefully monitor such on-line scrubbing operations.

With on-line as well as traditional off-line scrubbing it is important to achieve the highest possible degree of removal of all deposits and cleaning of the blades. The more complete the removal of such contaminants the better will be the operating efficiency of the apparatus and the less the frequency with which abrasive dry cleaning must be carried out, to the point that such abrasive cleaning can be rendered totally superfluous.

OBJECTS OF THE INVENTION

It is the principal object of the present invention to provide a cleaning solution which is capable of removing deposits and soiling contaminants from the compressor of a gas turbine, usually consisting of dirt, sand, salts, carbon dust, insect traces, oils, polymers, turbine flue gas residues, in an efficient manner.

Another object of the invention is to provide a cleaning solution for the purposes described which can be used for both on-line and off-line cleaning compressors especially those of gas turbines, with equal effect.

Still another object of this invention is to provide a cleaning solution which itself is combustible without the formation of detrimental by-products or combustion products and which, if included in waste water, is readily biodegradable so that it does not pose an environmental problem.

Still another object of the invention is to provide an improved method of cleaning the compressors of gas turbines especially those used for cogeneration or in other energy producing applications.

Still a further object of the invention is to provide an improved method of and composition for cleaning a compressor of a gas turbine without the formation of detrimental products upon combustion of the composition and which can be biologically decomposed and/or eliminated by calcium precipitation and adsorption.

DESCRIPTION OF THE INVENTION

These objects and others which will become apparent hereinafter are attained by providing a compressor scrubbing solution, especially for a compressor of a gas turbine which contains a heteropolar-compound consisting of:

- at least one member selected from the group which consists of alkaline cationic, wash active agents;
- at least one member selected from the group which consists of polymers and copolymers of organic unsaturated acids with a molecular weight of at least 500 capable of forming the heteropolar compounds with the alkaline cationically active, wash active agents; and
- at least one member selected from the group of nonionic wash active agents, the concentration for use having a metal ion content up to 25 ppm and a pH value between 6 and 8.

The cation active wetting and cleaning component can be selected from the group which consists of alkylamides, alkylamines, ethylene-oxide adducts with alkyl amines and alkylamides, alkylmethylenediamine, alkyltrimethylenediamine, alkyl-2-imidazoline, 2-alkyl-1-(2-aminoethyl)-2-imidazoline, 2-alkyl-1-(hydroxyethyl)-2-imidazoline, ethylenediaminealkyloxylates and quaternary basic ammonium compounds. The cation active agent can be formed into the heteropolar compound before the concentrate is formed by reaction with the polymer component or the two can simply be mixed together to form the compound.

The polymer or copolymer of an organic unsaturated acid with a molecular weight of at least 500 and capable of forming the heteropolar compounds with the abovementioned cation active wash active substances are preferably acrylic acid and/or maleic acid or copolymers thereof the molecular weight of such polymers or copolymers usually is between 2,000 and 5,000 although compounds with higher molecular weights of f.i. 50,000 to 70,000 can also be used. These polymeric acids generally have a pH value of 1 to 2 and are characterized by a high capacity for the dispersion of solids. For example, 150 to 200 milligrams of calcium carbonate can be dispersed in water by one gram of such polymer or copolymer.

Advantageously, the polymer or copolymers are resistant to high temperatures. For example, even at temperatures up to 150° C. and at the high temperatures at which such compressors operate, they may retain full effectiveness and will not degrade to give rise to decomposition products.

The preferred nonionic wash active substances are preferably block polymers and ethylene oxide adducts of fatty acids, aliphatic alcohols, alkyl phenols and polypropylene oxide derivatives in which all of these compounds have at least 6 carbon atoms and eventually ethoxylated sorbitol and sucrose esters.

A preferred feature of the invention requires that the heteropolar compound in combination with the nonionic wash active be present in demineralized water in their use concentrations at a pH value of 6 to 8, preferably 6.5 to 7.5.

The weight ratio between the cation active and nonionic wash active substances should preferably be between 20:1 and 1:20. It is preferred, however, that the composition contain an excess of the cation active wetting and emulsifying agent, namely, the heteropolar compound over the nonionic wash active substance. The proportion of the two active ingredients, namely, the heteropolar compound and the nonionic wash active substance in the cleaning solution should be between 1 and 25 weight % of the demineralized water vehicle, advantageously between 3 and 10% by weight.

The active ingredients can be provided in a concentrate which can then be diluted with demineralized water to the abovementioned concentration.

The polymeric organic acid dispersant can also be used in excess or in a deficiency so that initially the cleaning solution is not neutral and does not have a pH of 6 to 8 or preferably 6.5 to 7.5. In these cases the excess of the acid polymer is balanced by addition of alkaline organic agents, for example, ethanolamine or a deficiency of the acid organic substance is made up f.i. by the addition of gluconic or citric acid to set the preferred pH range.

SPECIFIC EXAMPLES

Example 1

An off-line cleaning concentrate for compressors of all types is comprised of 14% by weight lauric amine ethoxylated with 10 moles of ethylene oxide, 3.5 parts by weight of a modified polyacrylic acid and 7 parts by weight of $C_{13}$-alcohol formed into an adduct with 9 moles of ethylene oxide.

The modified polyacrylic acid has a molecular weight of 4000, a pH value of 1.5 and a calcium carbonate dispersive capacity of 170 milligrams $CaCO_3$ for 1 gram of polymer at 23° C. A 3.5% aqueous solution of this mixture is formed in 96.5% by weight water containing a maximum of 5 ppm of soluble solids and less than 0.5 ppm of total metals (Na+K+P+V) and a pH value of 6.5 to 7.5. 2 liters per minute of this solution is sprayed via 8 nozzles with a pressure of 6.7 bars for 30 minutes in an on-line operation and the compressor is then flushed with water for an equal time, the water being condensate water as specified above. The method was repeated daily and compressor efficiency was maintained over a 40 day regimen. Without the on-line washing there was an efficiency reduction of 1.5%.

EXAMPLE 2

A 10 megawatt turbine is scrubbed off-line with a cleaning solution comprised of 10 parts by weight quaternized fatty amine polyglycol ether, 5 parts by weight of a maleic acid based copolymer and 7 parts by weight of a $C_{10}$–$C_{18}$ fatty acid with 11 ethylene oxide moles per mole of the fatty acid. The cleaning solution was formed in a 5% concentration of these active ingredients in water with less than 100 ppm of soluble solids and an Na+K concentration below 25 ppm, the solution having a pH of 6 to 8.

The maleic acid based copolymer had a molecular weight of 2000, a pH value of 2 and a calcium carbonate dispersion power of 210 milligrams of calcium carbonate per gram of the solution at 23° C. and 190 milligrams $CaCO_3$ per gram of the solution at 60° C.

The compressor which lost efficiency by about 1.7% before cleaning has its full efficiency restored by the scrubbing with the 5% solution and rinsing with demineralized water.

Example 3

A 6.5 megawatt gas turbine is supplied with 40,000 $m^3/h$ of air contaminated with organic impurities in a test effort to avoid the need to clean the air in an expensive preliminary operation.

To clean the compressor which had a relatively high proportion of organic polymer contaminants therein, a 7% wash active solution in demineralized water was used in an off-line and in an on-line manner.

The wash active solution comprised 15 parts by weight of a stearylamine adduct with 12 moles of ethylene oxide, 6 parts by weight of maleic acid copolymer as described in Example 2, 7 parts by weight of a fatty alcohol polypropylene oxide adduct product with 10 moles of ethylene oxide and 16 parts by weight of an ester mixture consisting of 17% by weight dimethyl adipate, 66% by weight dimethyl glutarate and 17% by weight dimethyl succinate.

The ester mixture had the following data:

| | |
|---|---|
| Average molecular weight | about 160 |
| Specific gravity at 20° C. | 1.090 $g \cdot cm^{-3}$ |
| Refractive index | 1.423 |
| Distillation range | 200 to 230° C. |
| Vapor pressure at 20° C. | 0.08 mbar |
| Dynamic viscosity at 20° C. | 3 mPa · s |
| Evaporation rate at 80° C. | 0.031 g/mn |
| Flash point | 108° C. |
| Self-ignition point | 360° C. |
| Acid number (in mg KOH/g) | less than 0.3 |

-continued

| Atomic analysis | C, H, O |
|---|---|

This cleaning solution was found to be particularly effective for removal of organic polymer impurities and deposits and effectively maintained the efficiency of the compressor.

Example 4

15 parts by weight of each of the following basic reacting cationic substances, namely, octadecylmethylenediamine, dodecyltrimethylenediamine, decyl-2-imidazoline, 2-(heptyl)-1-(2-hydroxyethyl)-2-imidazoline and 2-octyl-1-(2-aminoethyl)-2 imidazoline was neutralized with modified polyacrylic acid (molecular weights between 800 and 70,000) to a pH value of 6.8 to 7.2. Then to each of these solutions 5 to 10 parts by weight of octyl phenol and nonyl phenol adducts with 7 to 12 moles of ethylene oxide were added. The resulting cleaning concentrates were used in the form of 3 to 15% solutions in demineralized water for on-line cleaning of compressors of gas turbines in accordance with the procedures described in Example 1 and all were found to provide excellent detergent effects for the impurities accumulated in the compressors.

Example 5

12 parts by weight of ethylenediaminealkoxylates with 10 moles of propylene oxide and 11 moles of ethylene oxide respectively and a quaternized tallow fatty amine polyglycol ether with a total of 10 ethylene oxide adduct molecules were neutralized with maleic acid copolymer as in Example 2 and having a molecular weight of 1000 to 10,0000, the solution being formed to 100 parts by weight with condensed water. To each solution 5 to 12 parts by weight of ethoxylated (17 moles) of sorbitol trioleate or sucrose esters of palm oil and stearic acid mixtures were added.

The cleaning concentrates in 2 to 20% solution in demineralized water were used effectively in both off-line and on-line cleaning of compressors as described.

Whenever the term alkyl or alkylated is used herein, the compound may be a $C_6$ to $C_{23}$ compound, preferably a fatty alkyl such as a $C_{12}$ to $C_{18}$ compound.

I claim:

1. A method of cleaning a compressor of a gas turbine comprising the steps of:

scrubbing said gas turbine with a cleaning solution consisting essentially of (I) at least one substance from the group of alkaline, cationic, wash active agents selected from the group which consists of alkylamides, alkylamines, ethylene-oxide adducts with alkyl amines and alkylamides, alkylmethylenediamine, alkyltrimethylenediamine, alkyl-2-imidazoline, 2-alkyl-1-(2-aminoethyl)-2-imidazoline, 2-alkyl-1-(hydroxyethyl)-2-imidazoline, ethylenediaminealkyloxylate and quaternary basic ammonium compounds, (II) at least one substance selected from the group which consists of polymers and copolymers of organic unsaturated acids with a molecular weight of at least 500 forming heteropolar compounds with the alkaline cationic, wash active agents, and (III) at least one substance selected from the group which consists of nonionic wash active agents, in a compressor-cleaning effective concentration, said solution in use having a metal ion content of less than 25 ppm and a pH value at said concentration between 6 and 8; and rinsing said compressor with demineralized water.

2. The method defined in claim 1 wherein said substance selected from the group which consists of polymers and copolymers of organic unsaturated acids is selected from the group which consists of polymers and copolymers or acrylic acid or maleic acid.

3. The method defined in claim 2 wherein said nonionic wash active agent is selected from the group which consists of ethylene oxide adducts of fatty acids, aliphatic alcohols, alkylphenols and polypropylene oxide derivatives having at least six carbon atoms.

4. The method defined in claim 3 wherein said nonionic wash active agent is an ethoxylated sorbitol or sucrose ester.

5. The method defined in claim 1 which further comprises at least one dimethyl ester of adipic acid, glutaric acid or succinic acid.

6. The method defined in claim 1 wherein the weight ratio between the cationically active and nonionic wash active agents ranges between substantially 20:1 and 1:20.

7. The method defined in claim 1 wherein said substances are present in demineralized water in a concentration between 1 and 25% by weight.

8. The method defined in claim 7 wherein said concentration is between 3 and 10% by weight.

9. The method defined in claim 1 wherein said pH is between 6.5 and 7.5.

* * * * *